United States Patent [19]

Kirsh et al.

[11] Patent Number: 4,919,296

[45] Date of Patent: Apr. 24, 1990

[54] CONTAINER

[75] Inventors: Janet A. Kirsh, Main Road; Cheryl A. Longobardi, Lot 884 Lieberts Lane, both of Brunkerville, New South Wales, 2323; Thomas Kirsh, Brunkerville, all of Australia

[73] Assignees: Janet A. Kirsh; Cheryl A. Longobardi, both of Brunkerville, Australia

[21] Appl. No.: 221,861

[22] Filed: Jul. 20, 1988

[30] Foreign Application Priority Data

Jul. 20, 1987 [AU] Australia ..... PI3198

[51] Int. Cl.[5] ..... B65D 1/30

[52] U.S. Cl. ..... 220/85 H; 220/410

[58] Field of Search ..... 220/85 H, 23.4, 903, 220/410, 413; 215/100 R, 12.1

[56] References Cited

U.S. PATENT DOCUMENTS

| | | | |
|---|---|---|---|
| 2,932,423 | 4/1960 | Baumgartner | 220/85 H |
| 2,961,121 | 11/1960 | Bergey | 220/85 H |
| 3,120,152 | 2/1964 | Horn et al. | 220/23.4 X |
| 3,194,426 | 7/1965 | Brown | 220/23.4 |
| 3,701,079 | 10/1972 | Bowden et al. . | |

*Primary Examiner*—Stephen Hepperle

*Attorney, Agent, or Firm*—Ladas & Parry

[57] ABSTRACT

A substantially rigid receptacle to receive a relatively flexible drink container of rectilineal form, the receptacle has a rectangular base and four rectangular sides and an open top, so as to provide a generally rectangualr hollow to receive the container, each of the four sides has a projection and a recess so that several of the receptacles may be secured together by mating engagement of the projections and recesses.

5 Claims, 1 Drawing Sheet

CONTAINER

The present invention relates to receptacles and more particularly to a receptacle adapted to receive a box containing liquid.

Fruit juice and milk are now commonly presented to the public in small cardboard boxes having one end provided with a small circular opening sealingingly but fracturably closed by a foil membrane. The membrane can be fractured by the insertion of a straw into the box to enable a user to withdraw liquid from within the container.

It is particularly convenient to give the above type of liquid container to a child, since if the container is inadvertently tilted or dropped, the contents are not easily spilled therefrom. Still further, the container is generally sealingly closed apart from the straw extending through the circular opening.

It is a disadvantage of the above method of distributing fruit juice, milk and other such liquids that if the box is gripped too tightly the liquid forced out through the passage and most likely through the straw. This problem is exacerbated when the box is given to a child, particularly a small child. This problem is particularly evident when the box is full.

It is the object of the present invention to overcome or substantially ameliorate the above disadvantage.

There is disclosed herein a substantially rigid receptacle to receive a relatively flexible drink container of rectilineal form, said receptacle being hollow and integrally moulded of plastics material so as to have a base, four sides and an open top, the sides being generally normal to the base, and arranged in parallel pairs, with the sides of one pair being generally normal to the sides of the other pair, said base and side walls encompassing a hollow to receive said container so that the container can be manipulated by a user gripping the receptacle without transferring any substantial compression force to the container, and wherein at least one of the sides has a projection, and another side has a recess so that two or more rectangular may be secured together by mating engagement of one of the projections of one of the receptacles with one of the recesses of another receptacle.

A preferred form of the present invention will now be described by way of example with reference to the accompanying drawings, wherein.

Figure 3:
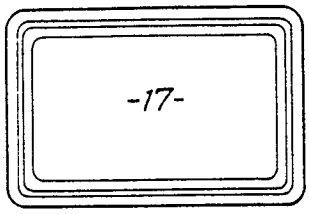
FIG. 3 is a schematic front elevation of the receptacle of FIG. 1.
Figure 2:
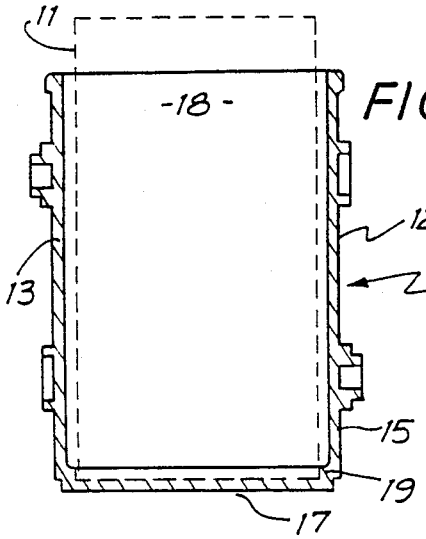
FIG. 2 is a schematic sectioned front elevation of the receptacle of FIG. 1.
Figure 1:
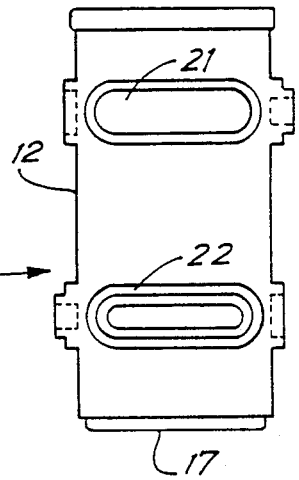
FIG. 1 is a schematic side elevation of a receptacle to receive a liquid containing package.
Figure 4:
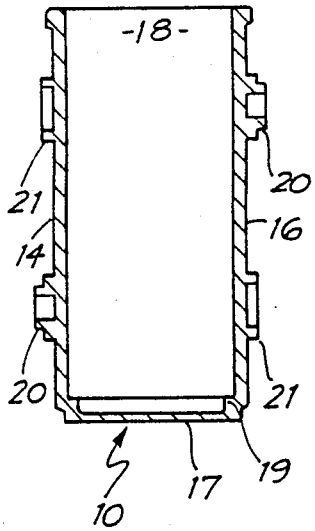
FIG. 4 is a schematic sectioned side elevation of the receptacle of FIG. 1.
Figure 5:
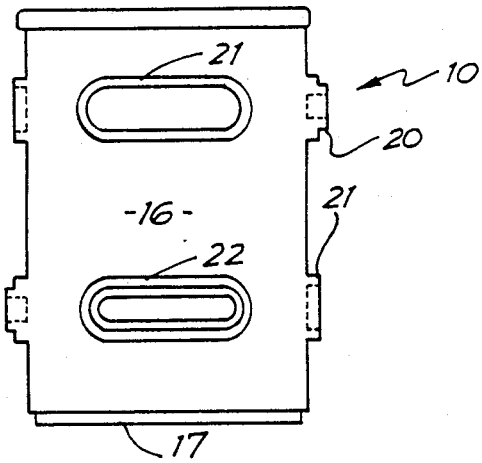
FIG. 5 is a schematic top plan view of the receptacle of FIG. 1.

In the accompanying drawings there is schematically depicted a receptacle 10 to receive a box 11 which contains a drinkable liquid such as fruit juice or milk. The receptacle 10 consists of a hollow body 12 having four walls 13, 14, 15, and 16, and a base 17. There is further provided an open top 18 enabling the body 11 to be inserted into the interior of the body 12. Located adjacent the base 17 is a lip 19 which engages the lower side surfaces of the box 11 to add in retaining the box 11 securely within the body 12.

The four side walls 13 to 16 are provided with snap engaging or friction engaging male and female members 20 and 21 to enable securing together of several of the receptacles 10 in a "building block" fashion.

If so required, the base wall 17 could also be provided with male and/or female members.

Preferably the receptacle 10 would be formed of a plastics material and would be provided with sufficient rigidity to inhibit deflecting of the side walls 13 to 16 so as to prevent the sides of the box 11 being depressed so as to expel liquid from within the box 11.

The base 17 is of a rectangular configuration, as are the four sides 13 to 16. Preferably, the receptacle 10 would be integrally formed by means of moulding a plastics material. The material would be such that the receptacle 10 would be generally rigid relative to the flexible liquid container which is to be located within the receptacle 10.

What we claim is:

1. A substantially rigid receptacle to receive a relatively flexible drink container of rectilineal form, said receptacle being hollow and integrally moulded of plastics material so as to have a base, four sides and an open top, the sides being generally normal to the base, and arranged in parallel pairs, with the sides of one pair being generally normal to the sides of the other pair, said base and side walls encompassing a hollow to receive said container so that the container can be manipulated by a user gripping the receptacle without transferring any substantial compression force to the container, and wherein at least one of the sides has a projection, and another side has a recess so that two or more receptacles may be secured together by mating engagement of one of the projections of one of the receptacles with one of the recesses of another receptacle.

2. The receptacle of claim 1 wherein said base is of generally rectangular form, and said four sides are each of a generally rectangular configuration.

3. The receptacle of claim 2 wherein the projections are frictionally received within the mating recesses.

4. The receptacle of claim 3 wherein said base is provided with a lip adapted to engage the container.

5. The receptacle of claim 4 wherein each side has a one of the projections, and one of the recesses.

* * * * *